US010260239B2

(12) United States Patent
Everett

(10) Patent No.: US 10,260,239 B2
(45) Date of Patent: Apr. 16, 2019

(54) WEDGE TREAD STAIR BOX SYSTEM

(71) Applicant: Francis West Everett, Hampstead, NC (US)

(72) Inventor: Francis West Everett, Hampstead, NC (US)

(73) Assignee: Convert-A-Stair, L.L.C., Wilmington, NC (US)

( * ) Notice: Subject to any disclaimer, the term of this patent is extended or adjusted under 35 U.S.C. 154(b) by 0 days.

(21) Appl. No.: 15/661,706

(22) Filed: Jul. 27, 2017

(65) Prior Publication Data

US 2019/0032340 A1 Jan. 31, 2019

(51) Int. Cl.

| | |
|---|---|
| ***E04F 11/035*** | (2006.01) |
| ***E04F 11/17*** | (2006.01) |
| ***E04F 11/025*** | (2006.01) |
| ***E04F 11/09*** | (2006.01) |
| ***E04G 21/30*** | (2006.01) |
| ***E04F 11/108*** | (2006.01) |
| *E04F 11/104* | (2006.01) |
| *E04F 11/02* | (2006.01) |

(52) U.S. Cl.

CPC ..... *E04F 11/035* (2013.01); *E04F 11/025* (2013.01); *E04F 11/09* (2013.01); *E04F 11/108* (2013.01); *E04F 11/17* (2013.01); *E04G 21/30* (2013.01); *E04F 2011/0207* (2013.01); *E04F 2011/1046* (2013.01)

(58) Field of Classification Search

CPC ..... E04F 11/17; E04F 11/025; E04F 11/09; E04F 2011/1046; E04F 2011/0207; E04F 11/035; E04F 11/108; E04G 21/30

See application file for complete search history.

(56) References Cited

U.S. PATENT DOCUMENTS

| | | | | | |
|---|---|---|---|---|---|
| 2,330,148 | A * | 9/1943 | Rogge | E04F 11/022 | 52/190 |
| 3,090,086 | A * | 5/1963 | Bernard Fata | B27F 1/00 | 403/381 |
| 3,978,628 | A * | 9/1976 | Turner | E04F 11/025 | 52/183 |
| 4,135,508 | A * | 1/1979 | Lyons | E04F 11/025 | 182/194 |

(Continued)

FOREIGN PATENT DOCUMENTS

| | | | | |
|---|---|---|---|---|
| CA | 2858006 A1 * | 4/2012 | ..... | E04F 11/025 |
| FR | 2655079 A1 * | 5/1991 | ..... | E04F 11/035 |

*Primary Examiner* — Adriana Figueroa
*Assistant Examiner* — Jessie T Fonesca
(74) *Attorney, Agent, or Firm* — Russell D. Nugent

(57) ABSTRACT

A stair box system made of a stair box core, stringers, risers and treads. The inner surfaces of the stringers have a discontinuous series of mortises positioned to engage only with the treads. Each tread is beveled from the front to back surfaces and each of the riser is beveled from the top to the bottom surface. Each tread features one or more notches cut into its back surface and each riser includes a complementary hook cut into its bottom surface. The hooks on the risers engage the notches on the treads forming an open-faced channel. Removable covers fit over the treads of the stair box core. These covers protect the stair box core and/or they feature decorative building materials like hardwood or tile. The system allows the user to upgrade their stairs by replacing the covers with covers featuring a different finished surface.

14 Claims, 8 Drawing Sheets

(56) References Cited

U.S. PATENT DOCUMENTS

| | | | | | |
|---|---|---|---|---|---|
| 4,322,927 | A * | 4/1982 | Scott | B28B 11/00 | 144/136.6 |
| 4,627,200 | A * | 12/1986 | Lapeyre | E04F 11/025 | 182/228.1 |
| 2009/0277104 | A1* | 11/2009 | McCool | E04F 11/108 | 52/179 |
| 2011/0179729 | A1* | 7/2011 | Thompson | E04F 11/104 | 52/179 |
| 2013/0255168 | A1* | 10/2013 | Keller | E04F 11/025 | 52/188 |

* cited by examiner

WEDGE TREAD STAIR BOX SYSTEM

BACKGROUND OF THE INVENTION

(a) Field of the Invention

The present invention is in the technical field of construction designs. More particularly, the present invention is in the technical field of stair case or stair box construction.

(b) Background Art

Traditionally, stair boxes for residential dwellings and commercial buildings have been built on site while a building is being constructed. To satisfy OSHA requirements and to complete construction, constructions crews have to provide a staircase for workers to access the upper floor(s). There are a number of solutions to this dilemma, with one of them being temporary stair boxes or stair cases built on site. However, temporary staircases tend to be unstable and unsafe. Using temporary stairs inevitably leads to other costs caused in particular by workplace injuries such as lost productivity, medical expenses and increased insurance premiums.

On the other hand, building better temporary stairs tends to waste time and resources. As a result, many builders install prefabricated stair boxes meant to be permanent, i.e., they are the stair boxes that will be in place when the construction is finished. Generally, the need and obligation for the stairs to be built arises early in the construction of a building or residence prior to the roof and walls being fully built. As a result, construction crews have traditionally been faced with a dilemma, namely, the stairs that are in place during construction are exposed to weather and the wear and tear of being used by the construction crews. However, the stair boxes need to have the appearance of being newly installed when the building is completed.

Prefabricated stair boxes have been on the market for years. Builders have the option of purchasing stair boxes that are already assembled and installing them into buildings as they are being built. Doing so saves them the time and trouble of building the stair box on site, but does nothing to solve the other problems presented by installing the stair box in the building before it is finished.

In their most basic form, prefabricated stair boxes are made of stringers, treads and risers. The stringers will have mortises[1] or trenches cut into them with a trenching tool or machine. Generally there is one continuous mortise cut into one of the two surfaces of the stringer that is meant to engage with each of the risers and the treads; also, there is a rounded section of each tread portion of the mortise that is to accommodate the noses that are usually featured on each tread. If the finished stairs are meant to be covered with a species of hardwood or some other durable material other than carpet, that hardwood or other material is incorporated into or makes up the treads that are part of the stair box. More specifically, when the stair box is built, the pre-cut or prefabricated treads made of the desired material are installed in the box as the treads. The treads and risers are installed into the stair box by attaching them to the stringers usually by nailing them into place. Since the prefabricated treads usually vary a little bit in width, wedge shaped pieces of wood are wedged into place on the underside of the stair box to reduce any "play" or lateral movement in the finished stair box—particularly any lateral movement of the treads. The prefabricated stair box is further stabilized by wedging additional pieces of wood into place on the underside of the stair box between the risers and the treads. This configuration helps to reduce any squeaking noise the stairs may make when weight is applied to them.

[1]Mortise is used in this disclosure as a noun and a verb. When used as a noun, it refers to a groove or trench cut into a surface. When used as a verb it refers to the act of inserting a projected piece of wood or other material into such a trench or groove.

Using a prefabricated stair box creates a number of problems in addition to damage and wear and tear on the stair box caused by the construction crew use of the stairs during construction. For example, to the extent that the finished stair case is supposed to inlcude hardwood or a material other than carpet, the hardwood or other material has to be installed with the stair box well in advance of the rest of the home being completed. That brings up two more problems, first, the decorative material on the stairs has to match the flooring that is in other parts of the home, but must be picked out well in advance of the rest of the flooring being installed. Second, when sheet rock is installed and then painted, generally there is some damage or mess created that requires sanding and/or refinishing the exposed surfaces of the treads and risers after all the rest of the work is completed. Performing this work can increase the length of time it takes the job to be finished by as much as two or three days.

On the other hand, replacing the hardwood surface making up the treads or risers almost requires the complete disassembly of the stair box. The treads and risers are nailed and wedged into place as described above with no surface underneath them. When someone wants to remove the treads and risers, they have to pry them loose from the stringers to which they are attached after all of the wedges mentioned above are removed. Doing so generally damages not only the stair box itself, but the surrounding structures including walls and base boards.

Consequently, the traditional prefabricated stair box presents construction crews with a number of problems to solve. As a result, the inventor, having worked for years in the industry, has devised a stair box system that solves the above problems in a more economical manner while decreasing the amount of labor required to install the stair box.

BRIEF SUMMARY OF THE INVENTION

The disclosed invention in its broadest form is a stair box system that is made of a core stair box that provides the structure of a stair box and is made of stringers, risers and treads. The core has certain unique features and provides a subfloor or core upon which to attach other parts of the system as described below.

The stair box core is formed by two stringers each with two surfaces—an inner surface that is meant to face the treads and risers and the opposite outer surface. Instead of a continuous mortise running the length of each stringer, common in conventional stairboxes, the inner surfaces of the stringers have a discontinuous series of mortises positioned to engage with the treads and not the risers. Each stair box core also includes a plurality of treads each having six (6) surfaces: a front surface, a back surface, a top surface, a bottom surface and two side surfaces. Similarly, each riser also has six (6) surfaces, namely a front surface, a back surface, a top surface, a bottom surface and two side surfaces. Moreover, each of the treads is beveled or tapered from the front to back surfaces, i.e. the front surface of each tread is a little bit wider than the back surface of each tread. Similarly, each of the risers is tapered or beveled in the similar manner—from the top surface to the bottom surface, i.e., the top surface is a little but wider than the bottom surface. During assembly of the stair box core, the treads are removably fixed to the stringers and then the risers are removably fixed to the treads using conventional fasteners, preferably screws. The treads are installed such that the narrower back surface of each tread is in contact with the narrower bottom surface of a riser. As a result, the stair box core is not completely "square" in that the width of the stair box at the front of the treads is greater than the width of the stair box at the back of the treads.

In additional embodiments of this system, each tread features one or more notches cut into its back surface and each riser includes a complementary hook cut into its bottom surface. However, a skilled artisan can appreciate that the structures could be reversed, i.e. the treads could feature hooks and the risers could feature notches. Regardless, when the risers and treads are assembled into the stair box core the treads are attached to the stringers after fitting their side surfaces into the mortises cut into the stringer's inner surfaces. As the risers are installed and attached to the treads, the hooks on the risers engage the notches on the treads. This arrangement has two basic advantages. First, it provides stability to the stair box and eliminates the need to place wedges or shims into or onto the bottom surface of the stair box to stabilize each step. Additionally, the hooks and notches form an open faced channel or groove on the underside of the stair box that can accept a separate structure. For example, in the best mode of this system, the inventor intends this channel to accommodate a separate piece of lumber or building material that can be used to facilitate attaching other structures, such as sheet rock, to the bottom of the stair box. Traditionally, sheet rock is simply nailed to the bottom of the stair box, but using a separate structure allows the builder to avoid nailing something into the underside of the stair box that could result in damage to the stair box during installation or removal.

Still further embodiments of this system include a plurality of removable covers configured to fit over the treads that are built as part of the stair box core. Each of these covers consists of a tread with six (6) surfaces, namely a front surface, a back surface, a top surface, a bottom surface and two side surfaces. In addition, the treads are also tapered or beveled from front to back making the front surface of the removable cover wider than the back surface. As a result of this tapering, the removable cover can be installed easily by sliding the cover over the surface of a tread that is part of the stair box—in doing so the fit between the stringers and the cover becomes tighter as the cover is slid in place over the tread. The removable covers are screwed into place for easy removal when the builder is ready to install finished hardwood or some other finished or decorative material onto the stair box. Similarly, the risers can be covered by a removable cover as well, but in fact the riser cover is not representative of the inventor's contemplated best mode.

In addition, these removable covers can be equipped with a nose. Typically, the treads of a stair box each feature a protrusion that extends past the point of contact between the top surface of the riser and the front surface of the tread. This protrusion is referred to as a nose and is generally a separate piece of wood or building material that is attached to the front surface of the tread. Because the nose is traditionally attached to the tread, it cannot withstand very much pressure placed directly on it without breaking loose, increasing the likelihood of a fall and damage to the tread. The inventor has taken advantage of the positioning of this structure to create a safety feature. The safety nose is a nose piece that is attached to the front surface of the tread portion of the removable cover via a mortised surface. The mortised surface reinforces the nose and makes it less likely to break off when pressure or weight is placed directly on it. The safety noses are ideally painted bright colors, such as orange, to make it easier to see the front surface or edge of each tread. This is especially important when the stair box is used in place of a temporary stair case in a building that is still under construction—the brightly colored nose helps construction crews spot the individual steps so that the surfaces of each step or stair do not visually appear to blend into each other. Such a feature tends to decrease the chances of a construction worker missing a step on the stair case and falling.

When construction is nearing completion, and the finish work has been completed, these removable covers can be removed to allow for the placement of the final finished surface. Alternately, carpet can be installed over the treads and risers of the stair box. If a non-carpeted surface is desired, the removable covers are removed and replaced with covers that are made entirely or partially of the desired finished material. For example, the final treads can be made of a finished hardwood or can feature a hardwood veneer. Similarly the final risers can be made entirely of or partially of a hardwood or other desired material. In preferred embodiments, the treads and/or risers are made of a medium density fiberboard with one or more surfaces covered with a decorative material such as hardwood or hardwood laminate. In preferred embodiments, the treads and risers are made of three layers—one layer of medium density fiberboard or plywood in the middle of two laminate layers. In addition, the outer surfaces of the treads and/or risers can feature other building materials such as tile or stonework. The finished treads and risers slide into place over the treads and risers that are part of the original stair box core. Because the treads and risers are beveled, sliding the treads and risers into place such that the back surface of the treads and the bottom surface of the risers tighten in place as they are pushed into place.

Hereinafter, the covers will be referred to generally by two different terms. "Safety cover" is the term that refers to the basic removable cover as they are typically used to both protect the stair box core and to aid the construction crew in seeing and identifying the individual steps as they use the stairs. The term "pre-finished cover" refers to the removable covers that feature some species of hardwood, laminate, or other decorative surface.

Another feature of this stair box system is a spacer board attached to the stringers. These spacer boards are attached to the outside surfaces of the stringers, i.e. the surfaces that are not engaged with the treads. This spacer board creates some separation between the stringers and the wall or other surface that is immediately adjacent to and flanks each of the stringers in a closed stair box system. Without the spacer in place, the dry wall or other wall building material, will need to be cut to conform to the shape of the individual stairs, i.e., multiple cuts will have to be made to fit the sheet rock around or over the individual treads and risers. In addition, the spacer boards can be used to join more than one stringer end to end, by attaching them to two stringers that are otherwise positioned end to end.

The inventor has adapted the above described system to a stair box with a single stringer, i.e., a stairway that is not flanked by walls immediately on one of its two sides. In these embodiments, the system works virtually identically to the system used for closed stairways; however, there is no need for the beveling of the treads and risers.

DETAILED DESCRIPTION OF THE INVENTION

Figure 1A:
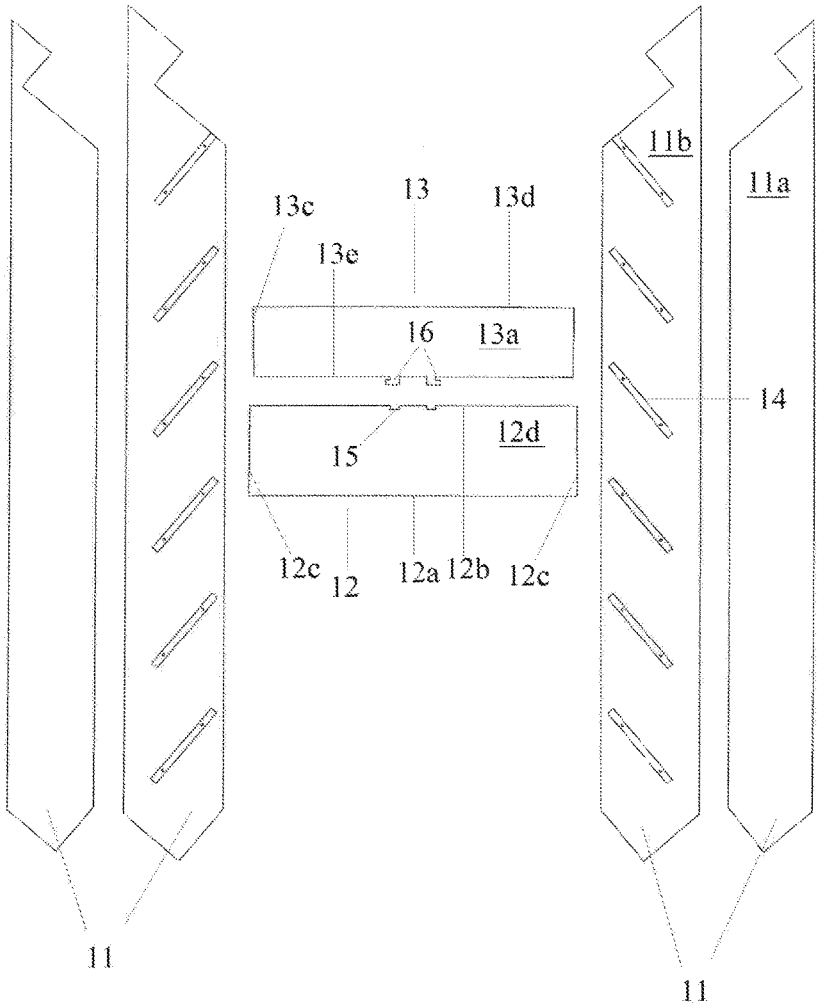
FIG. 1A is a top plan view of the various components of the stair box system.

Referring now to the invention in more detail, in FIG. 1 there is shown the basic components of the inventive stair box system. More specifically, each stair box system, generally 10, in its most basic form is comprised of stringers 11, treads 12 and risers 13. FIG. 1A shows each of four stringers 11, two of them in each of two orientations. That is to say that each stringer 11 has a, inner surface 11*a* and an outer surface 11*b*. The inner surface 11*a* of each stringer 11 has mortises 14 cut into it. The outer surface of each stringer 11 does not have mortises 14 cut into it. FIG. 1 also shows a tread 12 and a riser 13. Each tread has a front surface 12*a*, a back surface 12*b*, two side surfaces 12*c*, a top surface 12*d* and a bottom surface (not shown). Similarly, each riser 13 has a front surface 13*a*, a back surface (not shown), two side surfaces 13*c*, a top surface 13*d* and a bottom surface 13*e*. Note that the tread 12 features one or more notches 15 on its back surface. Similarly, each riser 13 features one or more hooks 16 on their back surface 13*b*. The hooks 16 and notches 15 are complementary, i.e., configured to engage securely with each other when the stair box core 23 is assembled.

Figure 1B:
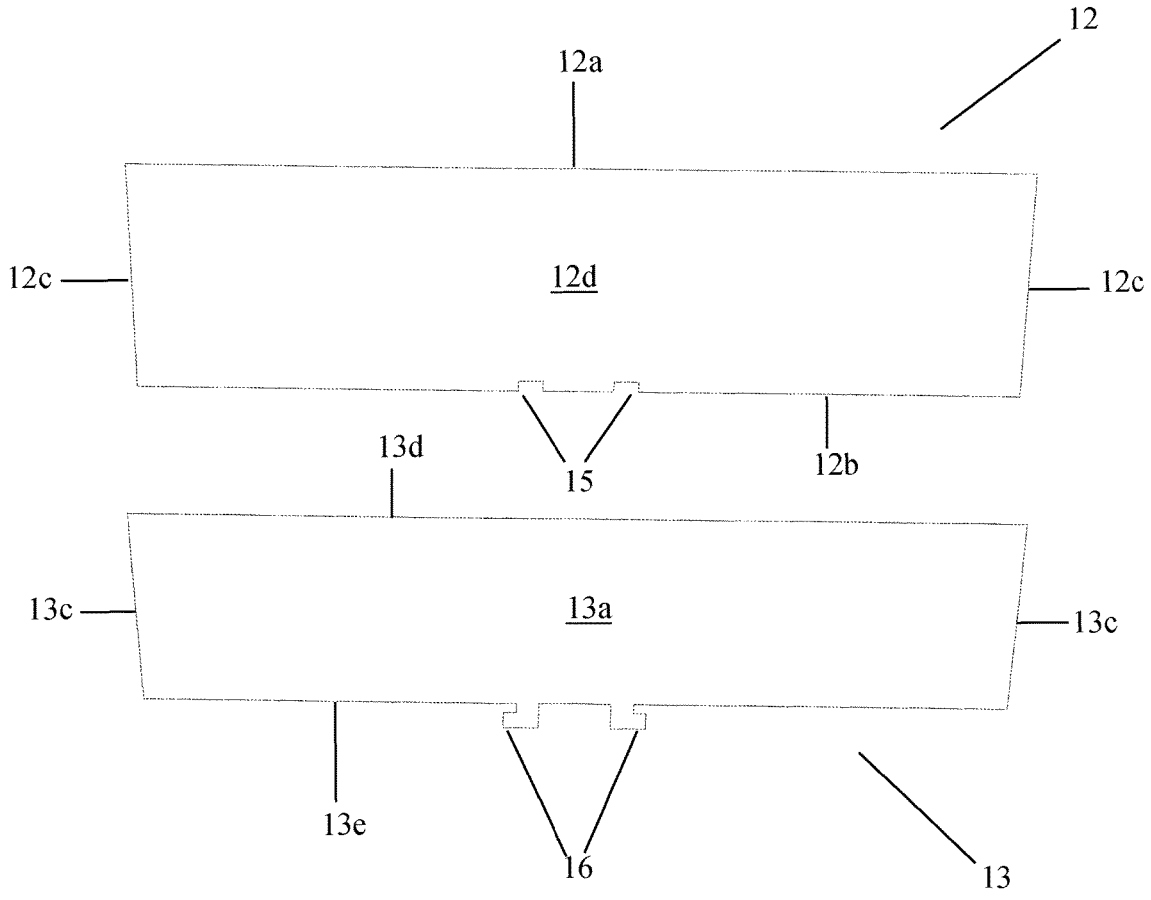
FIG. 1B is a top plan view of the treads and risers thereof.

FIG. 1B shows the treads 12 and risers 13 with the beveling exaggerated to make it more visually obvious. Each tread 12 has a front surface 12*a*, a back surface 12*b*, two side surfaces 12*c*, a top surface 12*d* and a bottom surface (not shown). Each tread 12 is beveled from then front surface 12*a* to the back surface 12*b* such that the front surface is wider than the back surface 12*b* that features the notches 15. Similarly, each riser 13 has a front surface 13*a*, a back surface (not shown), two side surfaces 13*c*, a top surface 13*d* and a bottom surface 13*e*. Each riser is beveled form the top surface 13*d* to the bottom surface 13*e* such that the top surface 13*d* is wider than the bottom surface 13*e*.

Figure 2A:
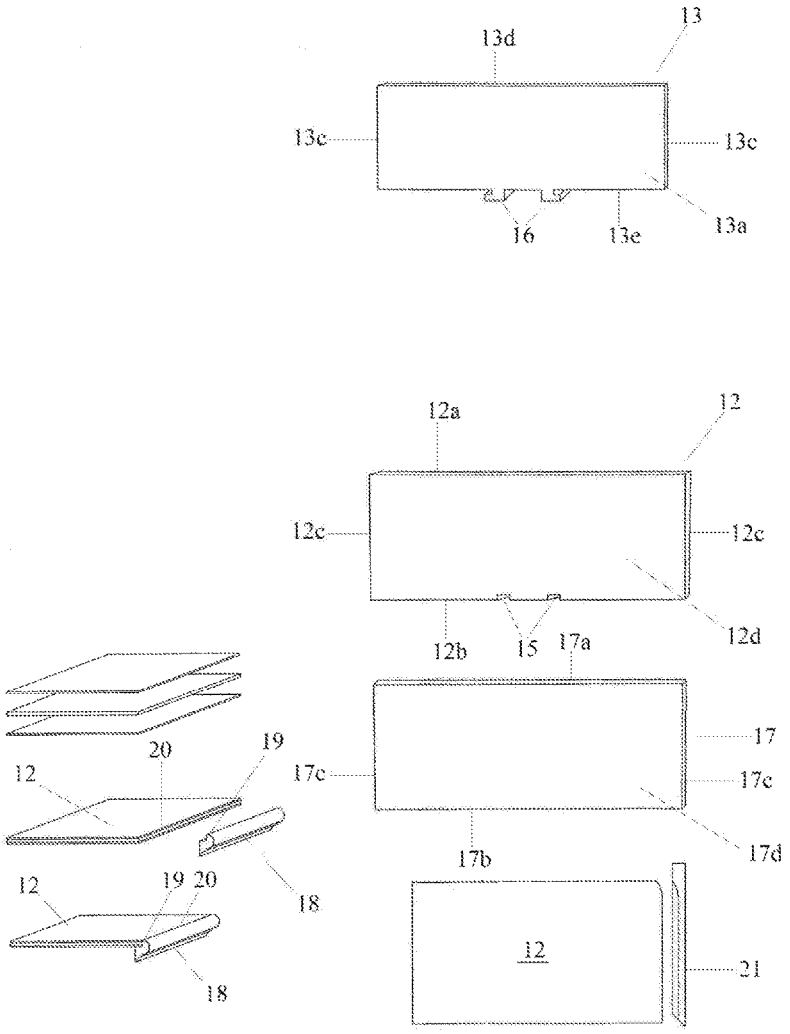
FIG. 2A is a top perspective view of the various components thereof.

FIG. 2A provides perspective views of the treads 12 and risers 13. Each tread 12 has a front surface 12*a*, a back surface 12*b*, a top surface 12*d*, a bottom surface (not shown) and two side surfaces 12*c*. Similarly, each riser features a front surface 13*a*, a back surface (not shown), a top surface 13*d*, a bottom surface 13*e* and two side surfaces 13*c*. As described above, the risers 13 each feature one or more hooks 16 and the treads 12 feature one or more notches 15. In preferred embodiments and the contemplated best mode, each riser 13 features two hooks 16 and each tread 12 features two notches 15. FIG. 2A also shows a tread cover 17 each with a front surface 17*a*, a back surface 17*b*, two side surfaces 17*c*, a top surface 17*d* and a bottom surface (not shown).

Figure 2B:
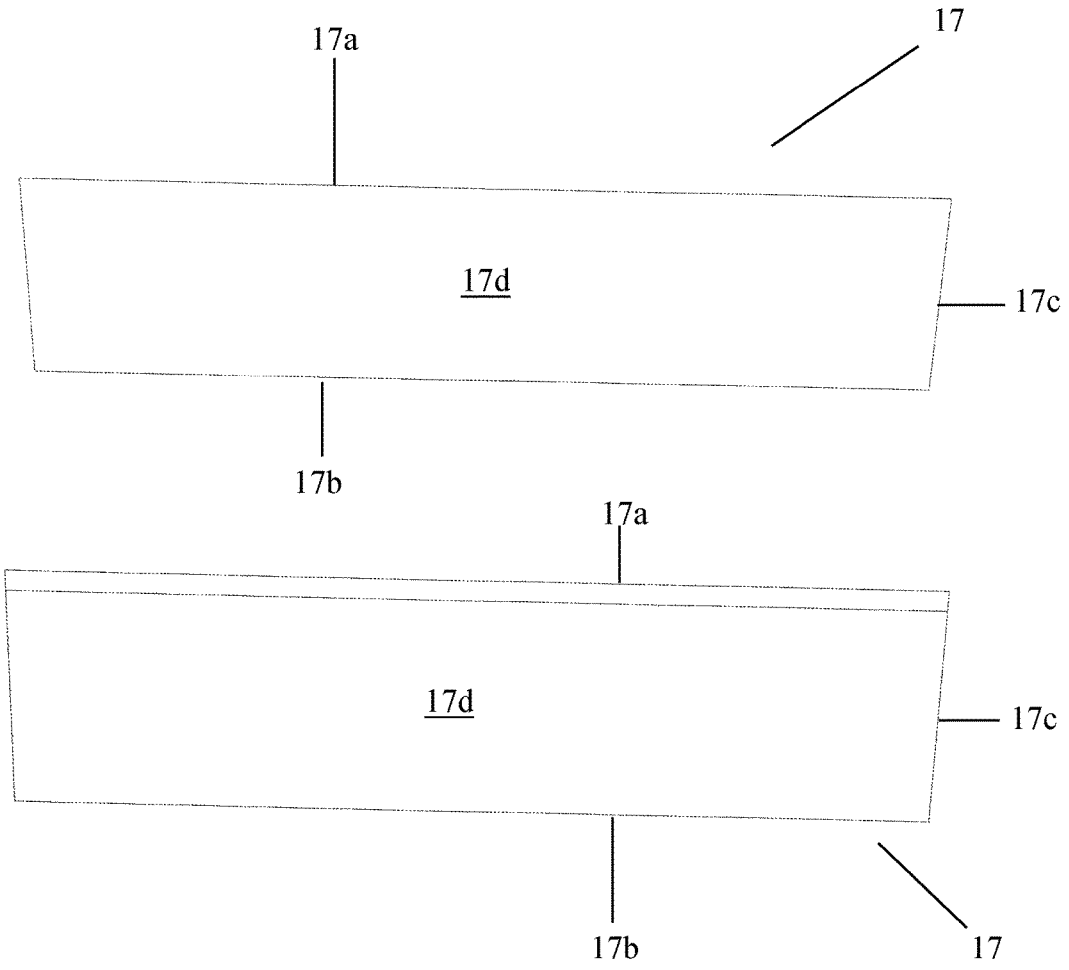
FIG. 2B is a top plan view of the covers thereof.

FIG. 2B shows examples of both tread and riser covers 17 with the beveling exaggerated to make it more visually obvious. More specifically, FIG. 2B shows a tread cover 17 each with a front surface 17*a*, a back surface 17*b*, two side surfaces 17*c*, a top surface 17*d* and a bottom surface (not shown). The tread cover 17 has a front surface 17*a* that is wider than its back surface 17*b* as previously discussed. In addition, FIG. 2B shows a riser cover 27 each with a front surface 27*a*, a back surface (not shown), a top surface 27*d*, a bottom surface 27*e* and two side surfaces 27*c* wherein the top surface 27*d* is wider than the bottom surface 27*e*.

In addition, FIG. 2 also shows the nose 18 that can be installed on the treads 12, particularly those treads 12 that are part of the safety cover (not shown). The nose 18 features a mortise 19 and the tread features a lip or tenon 20 that fits into the mortise 19 on the nose 18. This nose 18 is painted or otherwise features a color that makes the nose 18 more visible to someone walking up or down the stairs. FIG. 2 also shows a structural difference presented by versions of the stair box system 10 that are open, i.e., each side of the stair box is not flanked by a wall. In those embodiments, a mortised return 21 is fitted to the side surface 12*c* of each tread 12 such that the open side of the stair box features a return on most or all of the treads 12.

Figure 3:
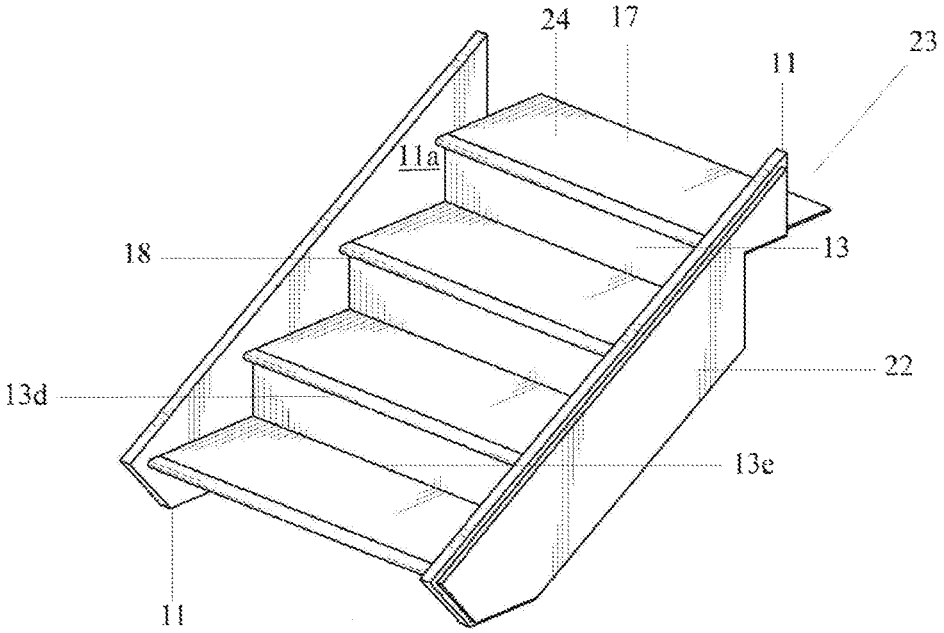
FIG. 3 is a top perspective view of an assembled stair box core.

FIG. 3 shows a perspective view of an assembled stair box core 23 with tread covers 17 in place featuring safety noses 18. The stair box core 23 is formed from two stringers 11, a plurality of treads (hidden from view by the trade covers 17) and a plurality of risers 13. The components of the stair box core 23 are joined together using traditional fasteners such as screws, nails, nuts and bolts, adhesives, etc. with screws being the preferred means of attachment in the contemplated best mode. The stair box core 23 contains two opposing stringers 11 forming the sides of the stair box core 23. Each stringer 11 has an inner surface 11*a* that faces towards the opposing stringer 11 and engages with the treads (not shown). Each stringer 11 also has an outer surface (not shown) that faces away from the opposing stringer 11 and treads 12. The outer surface of the assembled stair box core 23 can have attached to it a spacer board 22 meant to engage with a wall surface (not shown) such as a sheet of sheet rock. Returning to the stringers 11, the inner surfaces 11*a* of the stringers 11 have a discontinuous series of mortises (not shown) positioned to engage with the treads (not shown) and not the risers 13. In preferred embodiments, the mortises are cut to a uniform depth—it is the tapering of the treads and/or the risers 13 that gives the stair box core 23 its unique shape. The components of the stair box core 23 are preferably cut using a CNC machine. As discussed above each of the treads is beveled or tapered from the front to the back surfaces, i.e. the front surface 12*a* of each tread is a little bit wider than the back surface 12*b* of each tread. Similarly, each of the risers 13 is tapered or beveled in the similar manner—from the top surface 13*d* to the bottom surface 13*e*, i.e., the top surface 13*d* is a little but wider than the bottom surface 13*e*. During assembly of the stair box core 23, the treads are engaged in the mortises present on the inner surfaces 11*a* of the stringers 11. The risers 13 are removably fixed to the treads using conventional fasteners, preferably screws. The risers 13, treads 12 and stringers 11 form the base or subfloor of the stairway to which carpeting, hardwood or other materials can be attached to form a finished staircase.

In practice, the stair box core 23 is assembled off-site and shipped to the construction site to be installed. While construction is underway, the inventor anticipates the construction crew will install safety covers 24 made of whatever material is both durable and cheap such as pressed wood or plywood. The safety covers 24 can consist of covers for the risers 13 and the treads 12, but the inventor's contemplated best mode only includes tread covers 17. In other words, the safety covers 24 can be thought of as a type of tread cover 17, usually featuring a nose 18. The safety covers 24 can be attached to the stair box core 23 with conventional fasteners such as screws, nails, nuts and bolts, adhesives, etc. with screws being the preferred means of attachment. Just as the treads 13 described above, the safety covers 24 are beveled or tapered such that the front surface of the cover is a little bit wider than the back surface of the safety cover. As a result, they are meant to be slid over the surface of the treads 12 that are part of the stair box core 23 and when they are slid in place, the safety cover 24 fits snugly in place as it is beveled or tapered to the same degree as the underlying tread 12 of the stair box core 23.

If desired, the safety covers 24 can feature noses 18 as described previously. With the safety covers 24, the noses 18 are preferably painted a bright color that does not match or blend into the wooden surface to ensure the construction crew can easily see the edge of each tread 12 as they are using the stairs while they are working. Later, when the rest of the construction is complete, the dry wall has been installed and painted and the other finish and trim work has been completed, the construction crew can detach and remove the safety covers 24 from the stair box core 23 and install pre-finished tread covers (not shown) which are essentially tread covers 17 that feature whatever desired building material on its outer surfaces the builder or home-owner requires whether it be a species of hardwood, tile, stone work or other decorative surface. The pre-finished covers are configured to slide into place over the treads of the stair box core 23 and separate pre-finished covers are configured to slide in place over the risers 13 of the stair box core 23. The pre-finished covers, like the underlying treads and risers 13 of the stair box system 10 are beveled or tapered to fit into place over the treads 12 and risers 13 of the stair box core 23.

Figure 4:
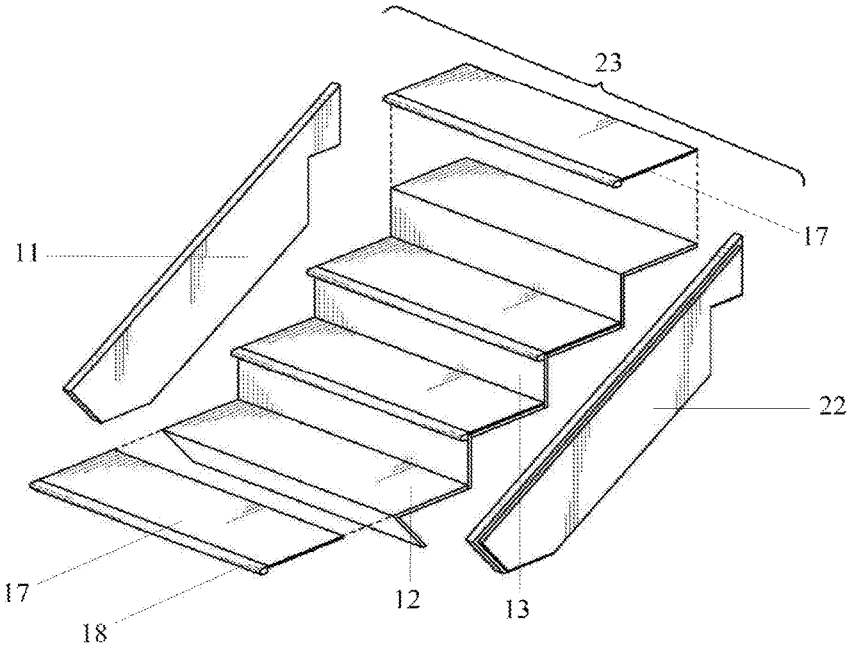
FIG. 4 is an exploded view of the stair box system showing the removable covers.

FIG. 4 shows and exploded view of the assembled stair box system 10 featured in the previous figure. As previously discussed, each stair box core 23 is made of two stringers 11, a plurality of treads 12 and a plurality of risers 13. The contemplated best mode of this system also includes spacer boards 22 fixed to the outer surfaces 11*b* of the stringers 11. FIG. 4 also shows the tread covers 17 both in place on the treads 12 and "exploded" away from the treads 12. As can be seen in FIG. 4, the tread covers 17 slide in place over the treads. First, the user places the back surface 17*b* of the tread cover 17 in contact with the top surface 12*d* of the tread 12 and then sliding the bottom surface 17*e* of the tread cover 17 over the top surface 12*d* of the tread 12 until the back surface 17*b* of the tread cover 17 contacts the riser 13. As previously discussed, the tread covers 17 that are used to cover and protect the treads 17 can be safety covers 24 or pre-finished covers 25. The difference between the two is both structural and functional. The tread covers that feature decorative material such as hardwood, are pre-finished covers 25. They are typically made of two layers of laminate with one layer of pressed wood, plywood or some other material sandwiched in between the laminate layers. They can be used to produce the final finished look of the stairs. In contrast, the safety covers 24 do not feature decorative materials and are in place for the purpose of protecting the stair box core 23. Both can feature a nose 18 as previously described.

Figure 5:
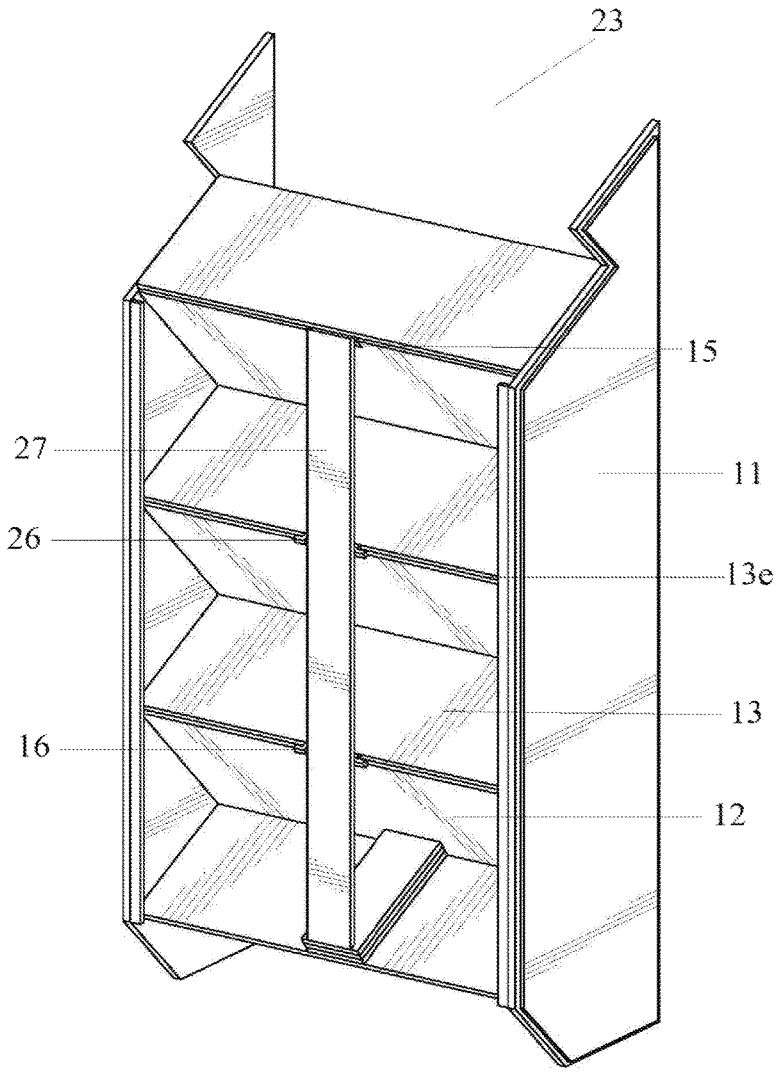
FIG. 5 is a bottom perspective view of an assembled stair box core.

FIG. 5 shows the underside of the stair box core 23. As discussed above, each tread 12 of the stair box core 23 features one or more notches 15 cut into its back surface 12*b* and each riser 13 includes one or more complementary hooks 16 cut into its bottom surface 13*e*. When the risers 13 and treads 12 are assembled into the stair box core 23 the treads 12 are attached to the stringers 11 after fitting their side surfaces 12*c* into the mortises 14 cut into each stringer's inner surface 11*a*. As the risers 13 are installed and attached to the treads 12, the hooks 16 on the risers 13 engage the notches 15 on the treads 12 forming an open faced channel 26 or groove on the underside of the stair box core 23 that can accept a separate structure 27.

Figure 6:
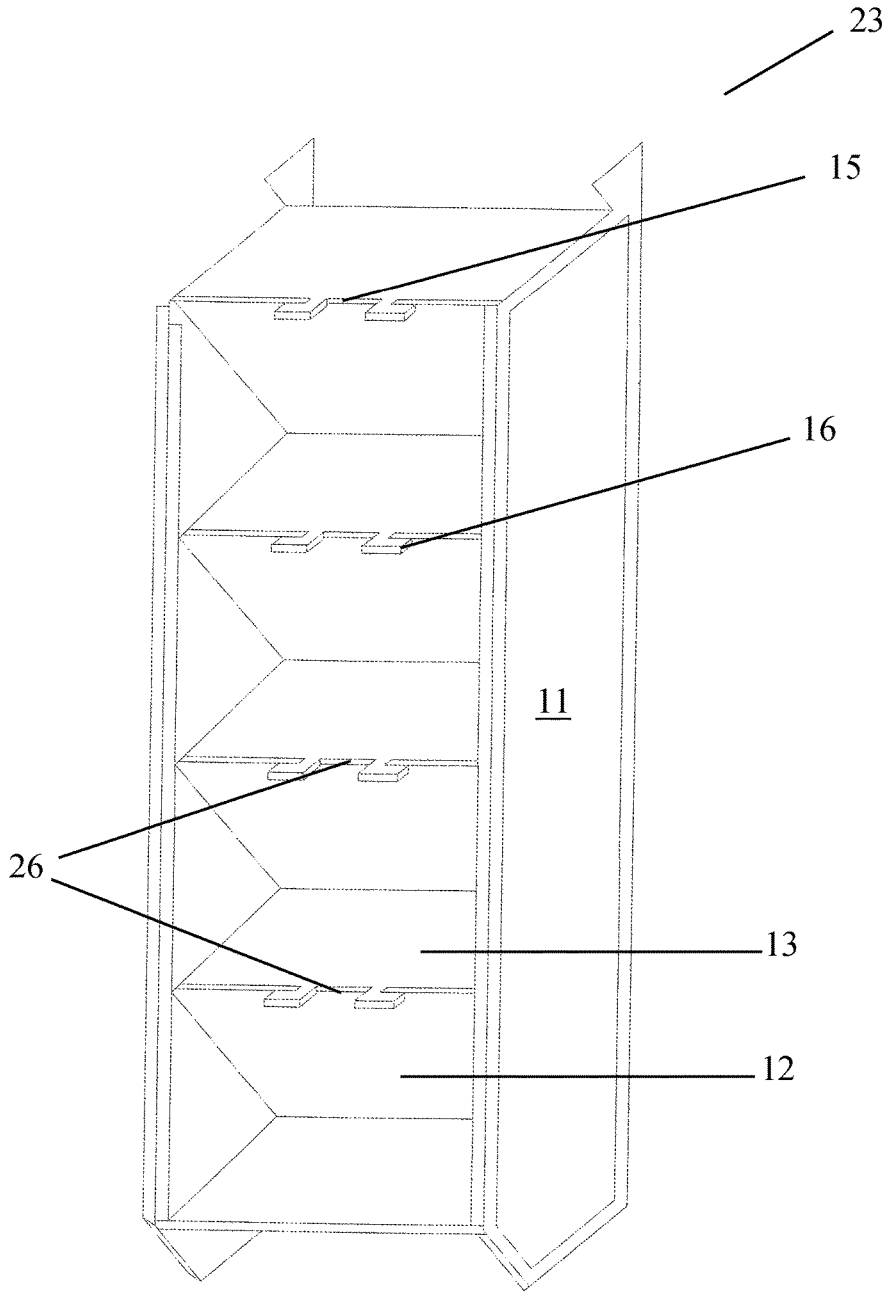
FIG. 6 is an additional bottom perspective view of an assembled stair box.

FIG. 6 shows the underside of the same stair box core 23 with the piece of material or separate structure 27 removed from the open faced channel 26. As discussed above, each tread 12 of the stair box core 23 features one or more notches 15 and each riser 13 includes one or more complementary hooks 16. When the risers 13 and treads 12 are assembled into the stair box core 23 the treads 12 are attached to the stringers 11. As the risers 13 are installed and attached to the treads 12, the hooks 16 on the risers 13 engage the notches 15 on the treads 12 forming an open faced channel 26 or groove on the underside of the stair box core 23 that can accept a separate structure 27 such as a length of wood. This configuration adds stability to the stair box 23 through the use of a structure 27 that can be easily removed without partially disassembling the stair box 23.

This stair box system represents a significant departure from the prefabricated stair boxes that are already on the market. Specifically, all of the pieces and parts of this system can be cut using CNC machining thus reducing the amount of manual labor required to produce a prefabricated stair box. In addition, using CNC machining also helps to decrease the incidence of workplace injuries. It also allows for more efficient use of the building materials, generally lumber, as the process can be used to cut multiple components from a single sheet of lumber. For example, the strip of lumber that fits into the open faced channel formed by the hooks and notches on the risers and treads can be made from scrap lumber.

In addition, the system offers a number of obvious advantages over traditional prefabricated stair boxes. First, the treads and risers can be replaced without doing significant damage to the stair box and surrounding walls. Second, the stair box can be protected from weather and the elements while the building it is seated in is constructed. In addition, as mentioned above, the ability to change the surfaces of the treads and risers after the rest of the building has been constructed and the finish work has been completed decreases construction time and costs. Fourth, the spacer allows for the drywall or sheet rock or to be put in place to form the walls around the stair box more easily as the wall material need not be cut to fit over each individual stair.

Moreover, the system makes it easy to use a color coding system to identify the sizes of materials needed to replace the treads and risers when the owner desires to replace the flooring or other material covering the stairs. More specifically, one color is used to identify the width of the treads and risers, another color is used to identify the depth or run of each of the treads and a third color is used to identify the rise or height of each of the risers. As a result, the owner can pull up the carpet or detach a single tread, note the colors painted on a surface of the stair box and then order the appropriate materials to replace the treads and risers with a new pre-finished surface. Above and beyond any other feature, this system is highly and easily customizable.

Reference throughout the specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout the specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

It is understood that the above described embodiments are only illustrative of the application of the principles of the present invention. The present invention may be embodied in other specific forms without departing from its spirit or essential characteristics. The described embodiment, including the best mode, is to be considered in all respects only as illustrative and not restrictive. The scope of the invention is, therefore, indicated by the appended claims, if any, in conjunction with the foregoing description.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

I claim:

1. A stair box system comprising:

two stringers each with a surface featuring a plurality mortises;

a first plurality of risers each having a top surface, a bottom surface, a front surface, a back surface and two side surfaces; wherein each riser is beveled from the top surface to the bottom surface such that the top surface is wider than the bottom surface;

a first plurality of treads having a front surface, a back surface, a top surface, a bottom surface and two side surfaces; wherein each tread is beveled from the front surface to the back surface such that the front surface is wider than the back surface; and wherein each side surface of each tread is configured to engage with the plurality of mortises featured on the stringers.

2. The stair box system of claim 1 further comprising:

a first plurality of removable covers, each configured to fit over and cover the top surface of a single tread of the first plurality of treads, each removable cover comprising:

a tread having a front surface, a back surface, a top surface, a bottom surface and two side surfaces; wherein each tread is beveled from the front surface to the back surface such that the front surface is wider than the back surface.

3. The stair box system of claim 1 wherein each tread of the first plurality of treads features at least one notch cut into the back surface of each tread and each riser of the first plurality of risers features at least one hook cut into the bottom surface of the riser; wherein each hook on each riser is configured to engage with the notch on each tread.

4. The stair box system of claim 3 wherein the hooks and notches form a groove configured to accept a separate length of material.

5. The stair box system of claim 2 wherein the top surface of each tread of the plurality of removable covers includes a pre-finished material.

6. The stair box system of claim 5 further comprising a second plurality of removable covers, wherein each removable cover of the second plurality of removable covers is configured to fit over and cover the front surface of a single riser of the first plurality of risers, each removable cover of the second plurality of removable covers comprising:

a riser having a front surface, a back surface, a top surface, a bottom surface and two side surfaces; wherein each riser is beveled from the top surface to the bottom surface such that the top surface is wider than the bottom surface.

7. The stair box system of claim 6 wherein the front surface of each riser of the second plurality of removable covers features a pre-finished material.

8. The stair box system of claim 2 wherein each tread on each of the plurality of removable covers features a mortised nose attached to the front surface of each tread and wherein the mortised nose is a different color than the plurality of the treads.

9. The stair box system of claim 4 further comprising:

a first plurality of removable covers, each configured to cover the top surface of a single tread of the first plurality of treads, each removable cover comprising:

a tread having a front surface, a back surface, a top surface, a bottom surface and two side surfaces; wherein each tread is beveled from the front surface to the back surface such that the front surface is wider than the back surface; and wherein each removable cover is configured to fit over and cover the top surface of a single tread of the first plurality of treads.

10. The stair box system of claim 9 further comprising a second plurality of removable covers, wherein each removable cover of the second plurality of removable covers is configured to fit over and cover the front surface of a single riser of the first plurality of risers, each removable cover of the second plurality of removable covers comprising:

a riser having a front surface, a back surface, a top surface, a bottom surface and two side surfaces; wherein each riser is beveled from the top surface to the bottom surface such that the top surface is wider than the bottom surface.

11. A stair box assembly comprising:

two stringers each with an inner surface featuring a plurality mortises;

a spacer board attached to an outer surface of each of the stringers;

a first plurality of risers each having a top surface, a bottom surface and two side surfaces, said risers being tapered from the top surface to the bottom surface such that the top surface is wider than the bottom surface;

a first plurality of treads having a front surface, a back surface, a top surface, a bottom surface and two side surfaces, said treads being tapered from the front surface to the back surface such that the front surface is wider than the back surface;

wherein each tread of the first plurality of treads features at least one notch cut into the back surface of each tread and each riser of the first plurality of risers features at least one hook cut into the bottom surface of the riser and each hook is configured to engage with the at least one notch on each tread; and wherein when the risers and treads are engaged, the hooks form a channel on an underside of the stair box, said channel being configured to accept a length of material; and wherein the plurality of mortises are configured to engage with the side surfaces of the treads;

a first plurality of removable covers, wherein each cover is configured to fit over and cover a single tread of the first plurality of treads.

12. The stair box system of claim 11 further comprising a second plurality of removable covers, each removable cover of the second plurality of removable covers is configured to fit over and cover a single tread of the first plurality of treads; wherein each of the second plurality of removable covers has a top surface that features a pre-finished material.

13. The stair box assembly of claim 12 further comprising a third plurality of removable covers, each removable cover of the third plurality of removable covers is configured to fit over and cover a single riser of the first plurality of risers; wherein each of the third plurality of removable covers has a front surface that features a pre-finished material.

14. A method of installing a pre-finished material on the stair box of claim 13 comprising:

placing each of the first plurality of removable covers over the top surface of each of the treads of the first plurality of treads;

detaching each of the first plurality of removable covers from each tread of the first plurality of treads;

sliding each of the covers of the second plurality of removable covers over the top surface of a single tread of the first plurality of treads;

sliding each of the covers of the third plurality of removable covers over the front surface of a single riser of the first plurality of risers;

removably attaching each of the covers of the second plurality of removable covers to the tread it covers; and removably attaching each of the covers of the third plurality of removable covers to the riser it covers.

* * * * *